US005176204A

United States Patent [19]

Ben-Dosa

[11] Patent Number: 5,176,204

[45] Date of Patent: Jan. 5, 1993

[54] CLEANING SYSTEM FOR CLEANING FLUID-CONDUCTING TUBING

[75] Inventor: Chaim Ben-Dosa, Herzlia, Israel

[73] Assignee: Balls-Technics Ltd., Herzlia, Israel

[21] Appl. No.: 809,630

[22] Filed: Dec. 16, 1991

[30] Foreign Application Priority Data

Dec. 27, 1990 [IL] Israel ..... 96802
Dec. 6, 1991 [IL] Israel ..... 100257

[51] Int. Cl.[5] ..... F28G 1/12
[52] U.S. Cl. ..... 165/95; 15/3.51
[58] Field of Search ..... 165/95; 15/3.5, 3.51

[56] References Cited

U.S. PATENT DOCUMENTS 4,435,285 3/1984 Okouchi et al. ..... 165/95
4,620,589 11/1986 Koller ..... 165/95
4,865,121 9/1989 Ben-Dosa ..... 165/95

FOREIGN PATENT DOCUMENTS 14196 1/1982 Japan ..... 165/95

*Primary Examiner*—John Rivell
*Assistant Examiner*—L. R. Leo
*Attorney, Agent, or Firm*—Benjamin J. Barish

[57] ABSTRACT

A cleaning system for cleaning tubing by circulating balls through the tubing includes a system for separating and recirculating the balls back to the upstream side of the tubing. The separator includes a hollow separator tube having perforations through its wall such that the balls accumulate in a chamber on the outer side of the hollow separator tube while the fluid flows through the interior of the hollow separator tube through a passageway to the atmosphere.

4 Claims, 7 Drawing Sheets

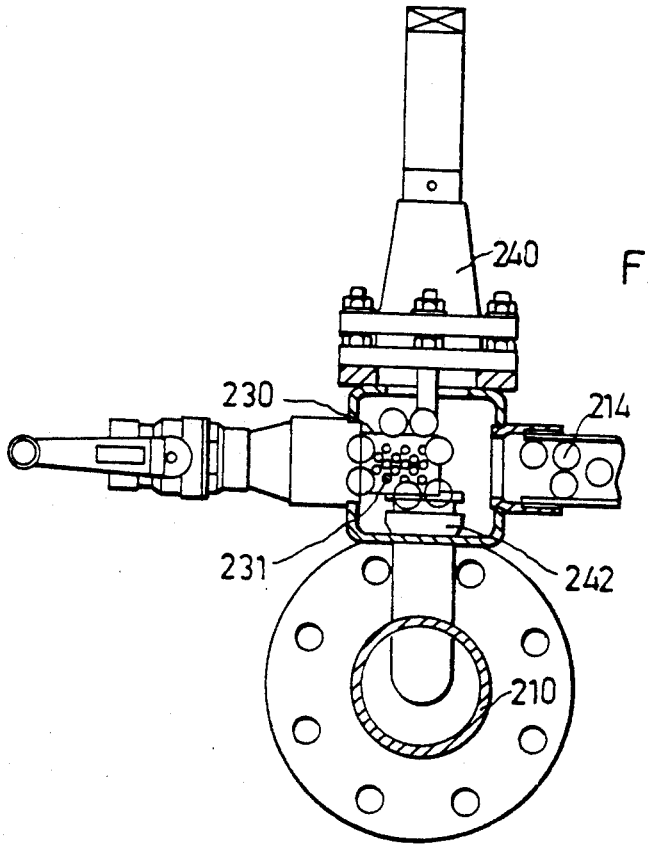
FIG.6
FIG.6a
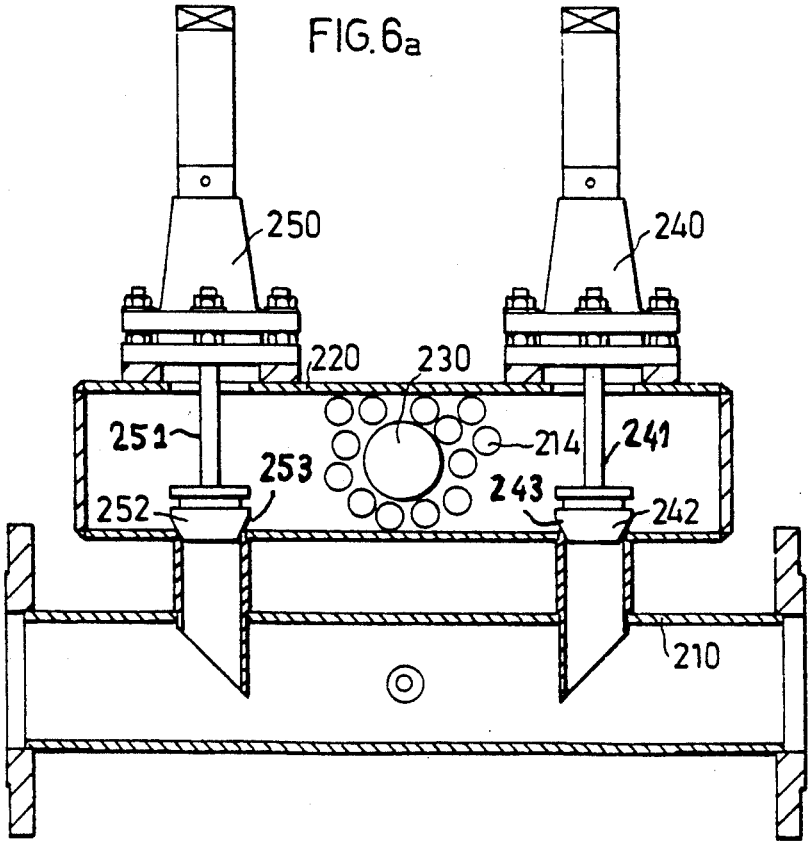

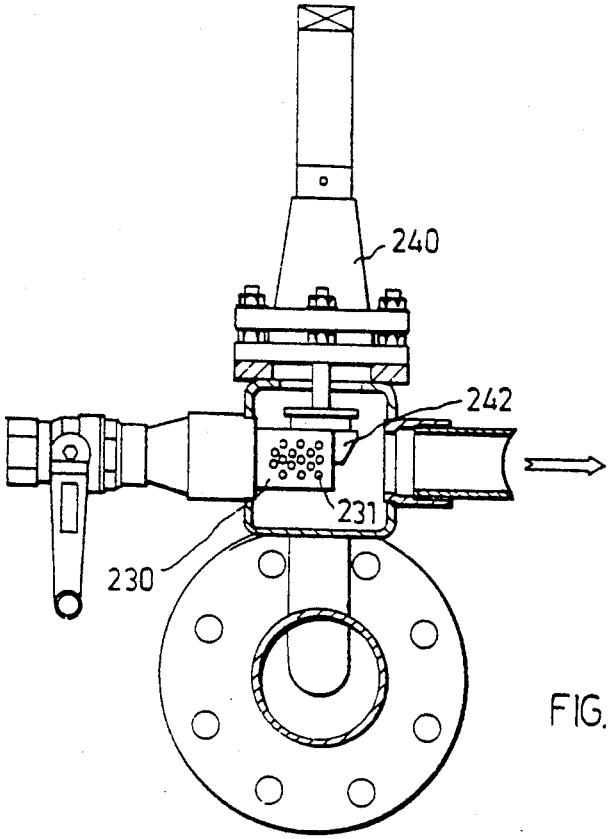
FIG.7
FIG.7a
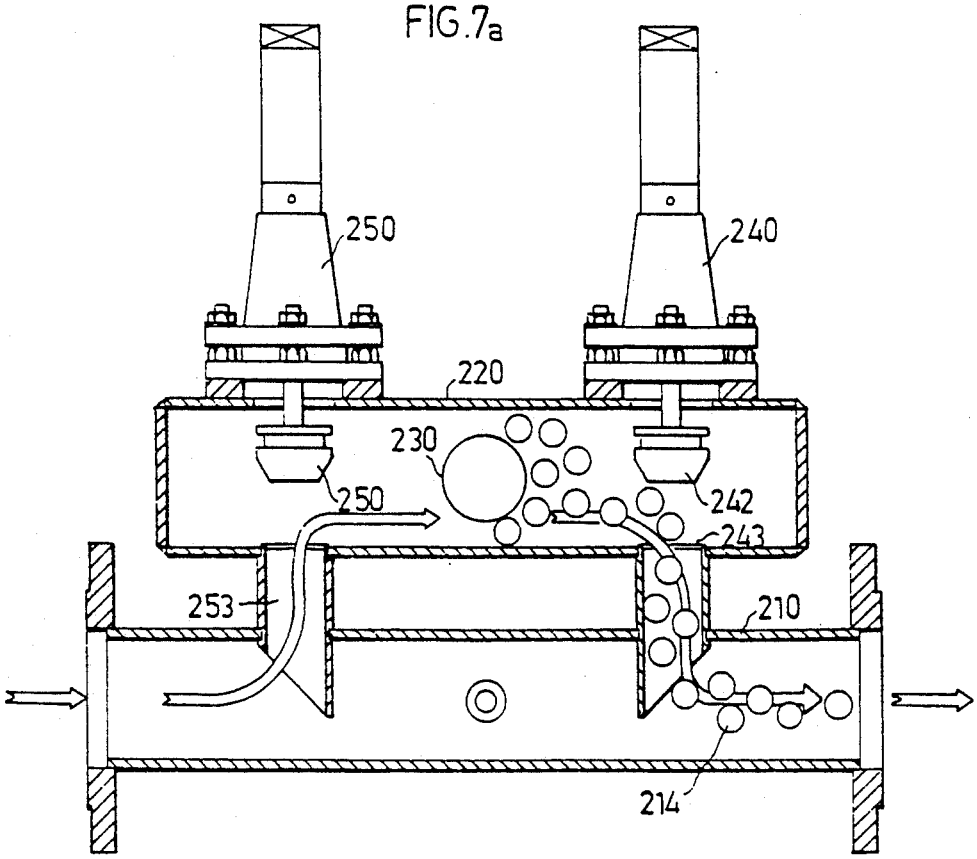

CLEANING SYSTEM FOR CLEANING FLUID-CONDUCTING TUBING

FIELD AND BACKGROUND OF THE INVENTION

The present invention relates to a cleaning system for cleaning fluid-conducting tubing. The invention is particularly useful in a condenser for cleaning the tubing of the heat-exchanger used in such a condenser, and the invention is therefore described below with respect to this application.

The present invention is particularly directed to an improvement in the cleaning system described in our U.S. Pat. No. 4,865,121. That patent describes a cleaning system for cleaning tubing used for conducting a fluid therethrough, which system includes balls circulated with the fluid through the tubing from its upstream side to its downstream side, means for separating the balls from the fluid at the downstream side of the tubing, and recirculating means for recirculating the balls back to the upstream side of the tubing; characterized in that the recirculating means comprises a chamber, a first passageway from the chamber to the downstream side of the tubing where the balls are separated from the fluid, and a second passageway leading from the chamber to the atmosphere or another point of lower pressure than in the chamber. The second passageway includes a valve effective when opened to produce, by the difference in pressure between the downstream side of the tubing and the atmosphere (or another point of lower pressure), a flow of the fluid and balls from the downstream side of the tubing to the chamber. The cleaning system further includes a separator between the chamber and the second passageway to permit the fluid, but not the balls, to flow through the second passageway to the atmosphere (or another point of lower pressure).

In one embodiment described in that patent, the system further included an ejector effective to positively eject all the balls collected in the mentioned chamber into the upstream side of the tubing; and in the separator was in the form of a screen defining one wall of the mentioned chamber adjacent to the second (outlet) passageway. However, in such an arrangement, the balls tend to accumulate on the inner surface of the separator screen, and therefore when the ejector is actuated to eject the balls collected in the chamber into the upstream side of the tubing, the balls tended to jam between the ejector and the inner surface of the screen. They thus interfere with the operation of the ejector, and also they become damaged during the operation of the ejector.

An object of the present invention is to provide a cleaning system of the foregoing type which eliminates the foregoing disadvantages.

OBJECTS AND BRIEF SUMMARY OF THE INVENTION

According to the invention of the present application, there is provided a cleaning system for cleaning tubing used for conducting a fluid therethrough, which system includes balls circulated with the fluid through the tubing from its upstream side to its downstream side, means for separating the balls from the fluid at the downstream side of the tubing, and recirculating means for recirculating the balls back to the upstream side of the tubing; the recirculating means comprising a chamber, a first passageway from the chamber to the downstream side of the tubing where the balls are separated from the fluid, and a second passageway leading from the chamber to a point of lower pressure than in the chamber; a valve in the second passageway effective when opened to produce, by the difference in pressure between the downstream side of the tubing and the point of lower pressure, a flow of the fluid and balls from the downstream side of the tubing to the chamber; and a separator between the chamber and the second passageway to permit the fluid, but not the balls, to flow through the second passageway to the point of lower pressure; the latter separator including a hollow separator tube having perforations through its wall such that the balls accumulate in the chamber on the outer side of the hollow separator tube while the fluid flows through the interior of the hollow separator tube through the second passageway to the point of lower pressure.

BRIEF DESCRIPTION OF THE DRAWINGS

The invention is herein described, by way of example only, with reference to the accompanying drawings, wherein:

FIG. 6 is an enlarged fragmentary view illustrating particularly the separator chamber portion of the system of FIG. 5 in which the cleaning balls are accumulated, FIG. 6*a* being a side elevational view of FIG. 6; and FIG. 7 is a fragmentary view of the separator portion of the system of FIG. 5 but showing the condition of the parts when the balls accumulated therein are recirculated back into the system, FIG. 7*a* being an enlarged side elevational view of FIG. 7.

DESCRIPTION OF PREFERRED EMBODIMENTS

Figure 1:
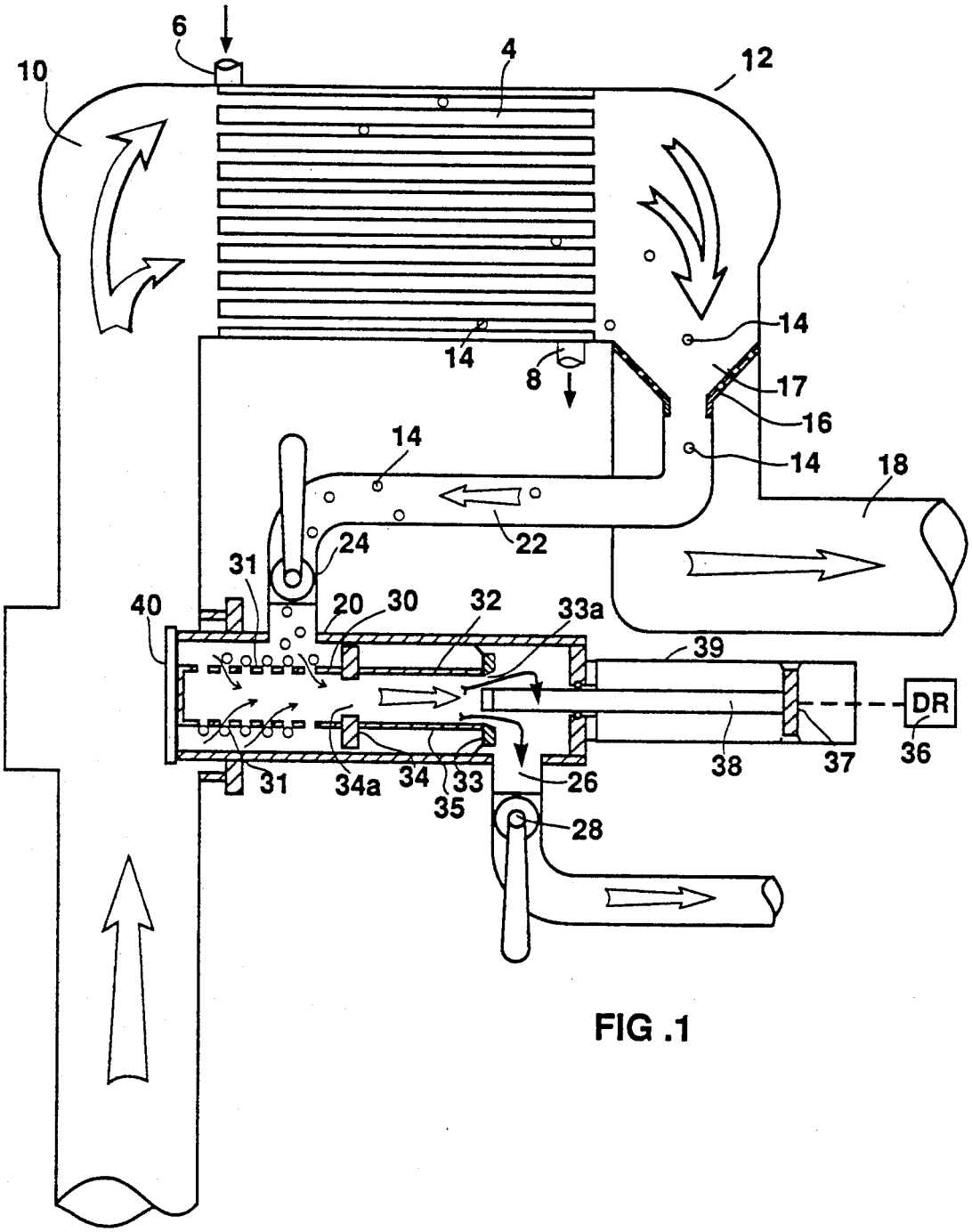
FIG. 1 illustrates one form of cleaning system constructed in accordance with the present invention.
Figure 2:
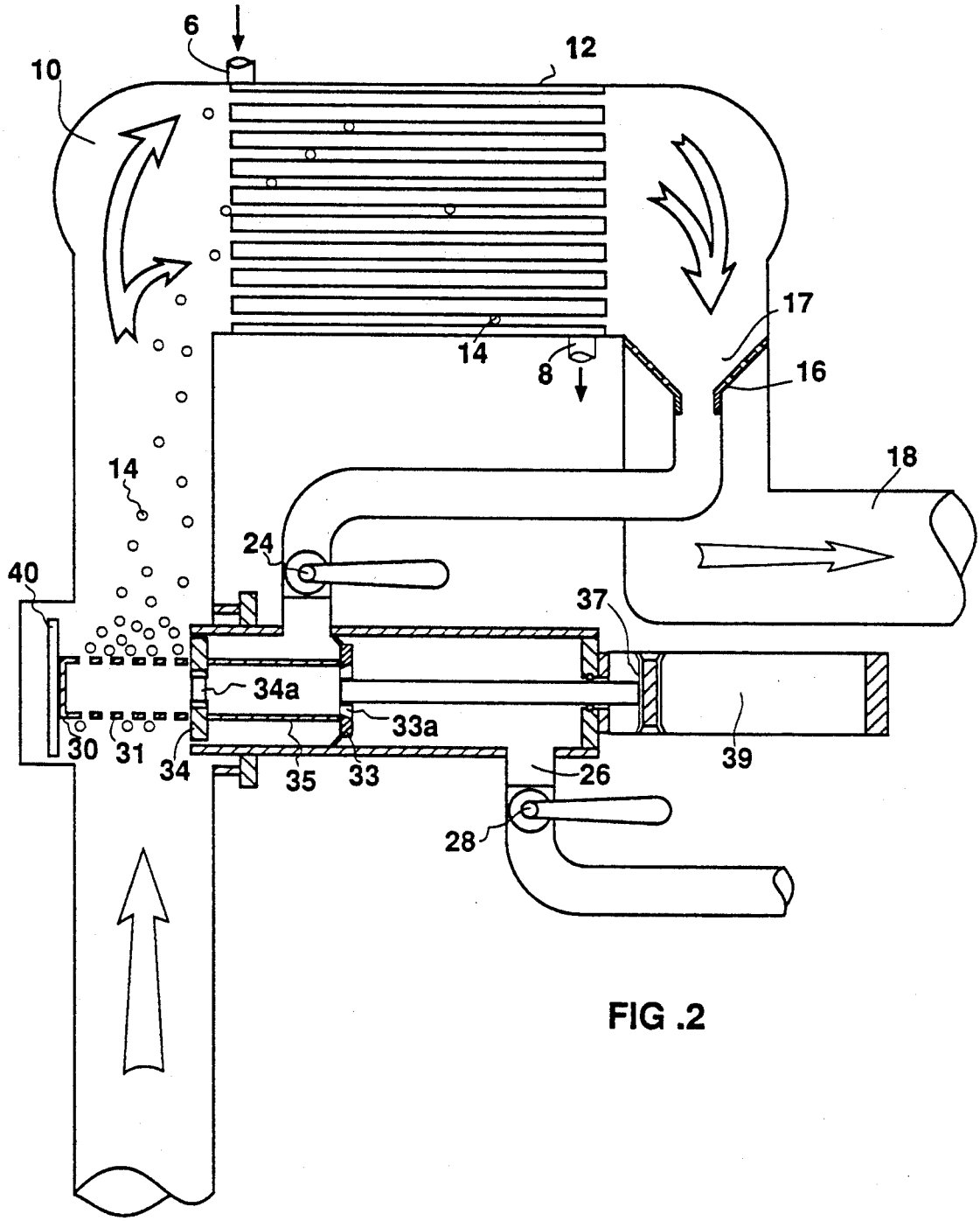
FIG. 2 illustrates the system of FIG. 1 when the system has been actuated to recirculate the balls through the tubing.

The cleaning system illustrated in FIGS. 1 and 2 comprises a condenser, generally designated 2, including tubing 4 in the form of a plurality of parallel, spaced tubes, through which the cooling fluid, such as water, is passed in order to condense a fluid, such as steam or a refrigerant gas, circulated from an inlet 6 through the spaces between the condenser tubing 4 to an outlet 8. The cooling liquid is circulated through the condenser tubing 4 from an inlet header 10 at the upstream side of the condenser tubing to an outlet header 12 at the downstream side.

In order to prevent the lodging or settling of particles within the condenser tubing 4 which tend to clog or erode the tubing, the cooling liquid includes a plurality of cleaning balls 14 forced through the tubing 4 with the cooling liquid. Balls 14 are slightly larger in diameter than the condenser tubes 4 so that they rub against the inner walls of the tubes and thereby maintain them clean. Thus, any solid particles suspended in the cleaning liquid are kept moving and not allowed to settle, thereby preventing clogging of the tubes. This technique of using cleaning balls for cleaning the tubing in condensers and other forms of heat-exchangers is well-known, and therefore further details of such a cleaning system, or of the balls 14 used in this type of system, are not set forth herein.

The outlet header 12 includes a separator or strainer in the form of a conical screen 16 in region 17 at the downstream side of the condenser tubing 4. Screen 16 separates the cleaning balls 14 from the cooling liquid, as the cooling liquid passes through separator 16 to the cooling liquid outlet 18.

The cleaning balls 14 thus separated by separator 16 are fed to a chamber 20 via a connecting passageway 22 as controlled by a valve 24. Chamber 20 is connected to a second passageway 26 via a second valve 28 leading to the atmosphere or to another point of lower pressure than in region 17.

Chamber 20 includes a hollow separator tube 30 having perforations 31 through its wall, such that when valve 28 is open, the cooling liquid in chamber 20 flows into the interior of the hollow separator tube 30 and therethrough into passageway 26 and out to the atmosphere, or to a point of lower pressure; on the other hand, the balls 14, being blocked by the openings 31, accumulate on the outer surface of tube 30.

Chamber 20 further includes an ejector, generally designated 32, which is periodically actuated for injecting the balls 14 collected on the outer face of the hollow separator tube 30 into the cooling liquid passing into the inlet header 10 at the upstream side of the condenser tubing 4 for recirculation through the tubing.

More particularly, ejector 32 includes a pair of pistons 33, 34, connected by a non-perforated tube 35 extending within chamber 20. Ejector 32 is actuated by any suitable drive, such as a source of fluidized pressure schematically indicated by box 36, to actuate a piston 37 connected to piston 33 by a stem 38. Piston 37 and stem 38 move within another cylinder 39 aligned with one end of chamber 20. The opposite end of chamber 20 is closed by an end disc 40 fixed to the respective end of the hollow separator tube 30. The opposite end of the hollow separator tube 30 is fixed to pistons 33 and 34 via the non-perforated tube 35, and to piston 37 via stem 38.

During the normal operation of the condenser, valves 24 and 28 are in their closed positions, and the ejector is in its retracted position within chamber 20. Accordingly, during the normal operation of the condenser, the cleaning balls 14 forced through the condenser tubing 4 are separated by screen 16 and collect within region 17 at the downstream side of the condenser tubing 4.

Periodically, or whenever it is desired to recirculate the balls back to the upstream side of the condenser tubing 4, both valves 24 and 28 are opened, as shown in FIG. 1, so as to produce a flow of the liquid, together with balls 14, from region 17 through passageway 22 and into chamber 20. Since valve 28 is also open, connecting passageway 26 to the atmosphere or to a point of lower pressure than that in that chamber 20, the liquid flows through openings 31 in the hollow separator tube 30, through openings **34*a* and 33*a* in pistons 34 and 33, respectively, into passageway 26 and out to the atomosphere or to the point of lower pressure. During this flow of the liquid, the balls within chamber 20 accumulate on the outer face of the hollow separator tube 30**.

Valves 24 and 26 are then closed, and the ejector 32 is actuated by drive 36 to its extended position as illustrated in FIG. 2, so that the balls which accumulated on the outer surface of the hollow separator tube 30 are thus introduced into the inlet header 10 at the upstream side of the condenser tubing 4, for recirculation through the tubing. After the balls have thus been ejected into the inlet header 10, ejector 32 is then returned to its normal retracted position within chamber 20 as illustrated in FIG. 1.

It will thus be seen that since the balls accumulate on the outer surface of the hollow separator tube 30, they do not interfere with the ejector 32 when it is actuated to its extended position as illustrated in FIG. 1. Thus, the balls cannot jam the ejector, nor can they be damaged by the actuation of the ejector.

Figure 3:
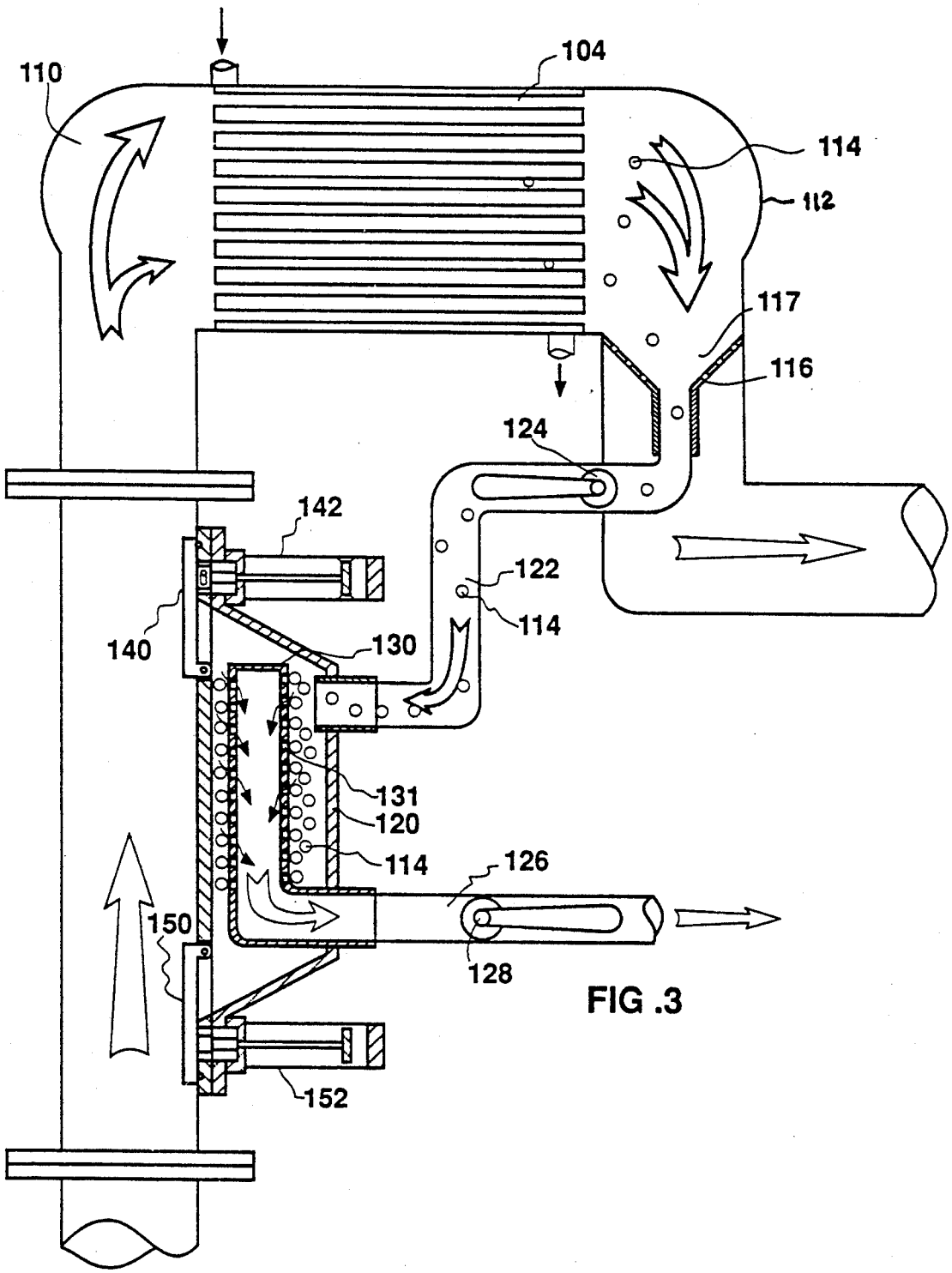
FIG. 3 illustrates a second form of cleaning system cosntructed in accordance with the present invention.
Figure 4:
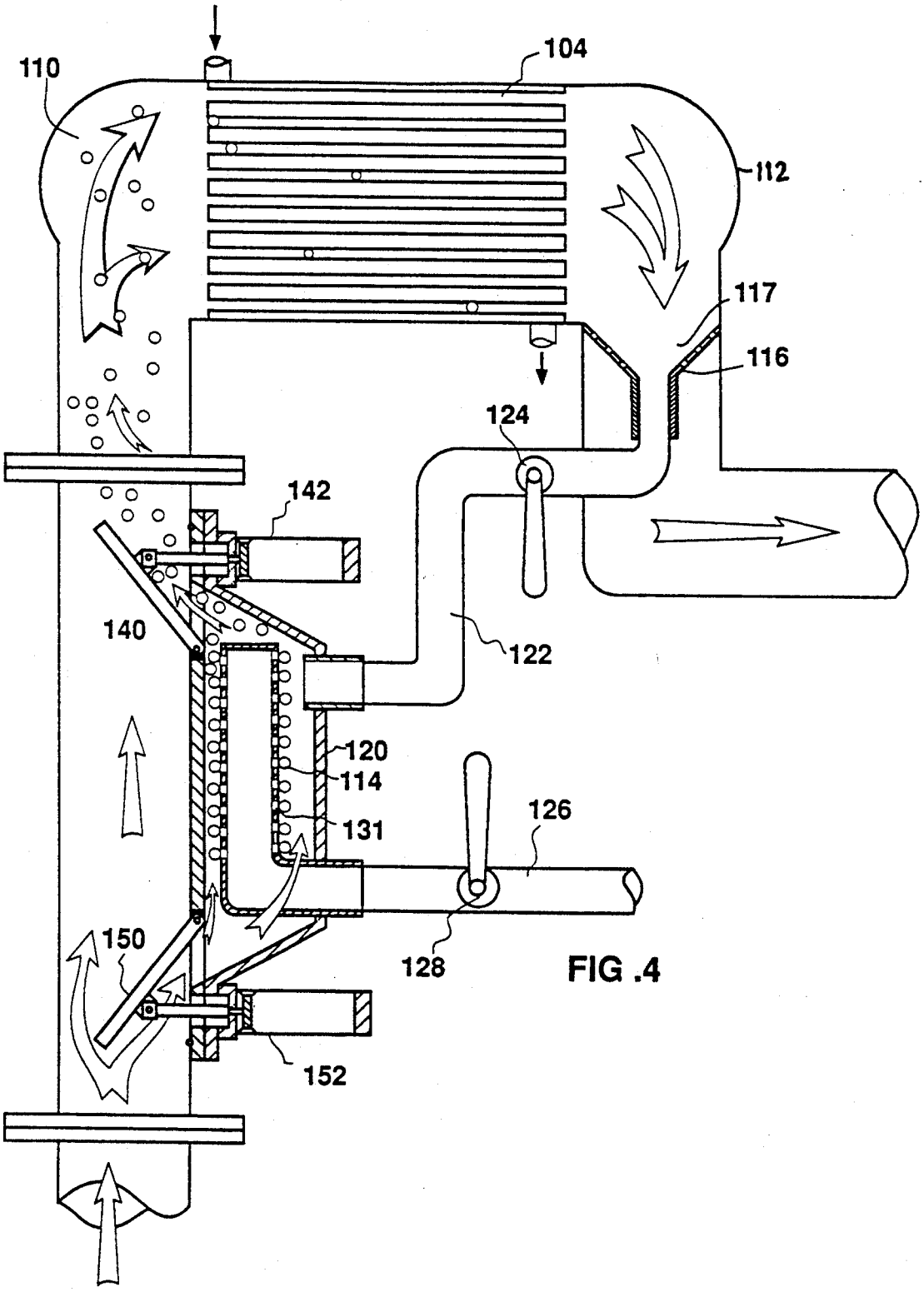
FIG. 4 illustrates the cleaning system of FIG. 3 in the actuated condition during which the balls are recirculated back through the tubing.

FIGS. 3 and 4 illustrate a condenser very similar to that of FIGS. 1 and 2, except that instead of including an ejector (32 in FIGS. 1 and 2) for injecting the balls, designated 114 in FIG. 3, back into the inlet header 110, this function is effected by providing two valves, generally designated 140 and 150, respectively, at the opposite ends of the chamber 120 in which the balls 114 are collected.

More particularly, the balls 114 passing through the condenser tubing 104 with the liquid to the outlet header 112, are also separated by conical screen 116 so as to accumulate within region 117, and when the two valves 124, 128 are opened, the balls and liquid pass via connecting passageway 122 into chamber 120 containing the hollow separator tube 130, where the balls are separated from the liquid, permitting the liquid to pass through passageway 126. The balls, thus being blocked by openings 131 in the hollow separator tube 130, accumulate in the outer surface of the hollow separator tube.

When it is desired to reintroduce the balls collected within chamber 120 back into the inlet header 110, both valves 140 and 150 are opened, as shown in FIG. 4. Valve 140 is between one side of chamber 120 and a point at the upstream side of the tubing 104 and is actuated by a fluid actuator 142; whereas valve 150 is actuated by a second fluid actuator 152 and is located at the opposite side of chamber 120, also at the upstream side of the condenser tubing 104 but at a point further upstream than the location of valve 140. Accordingly, when both valves 140 and 150 are opened by their actuators 142, 152, respectively, fluid flowing to the inlet header 110 at the upstream side of the condenser tubing 104 passes through chamber 120 and washes the balls 114 accumulating therein into the inlet header 110.

In all other respects, the condenser illustrated in FIGS. 3 and 4 is constructed, and operates in the same manner, as described above with respect to FIGS. 1 and 2.

Figure 5:
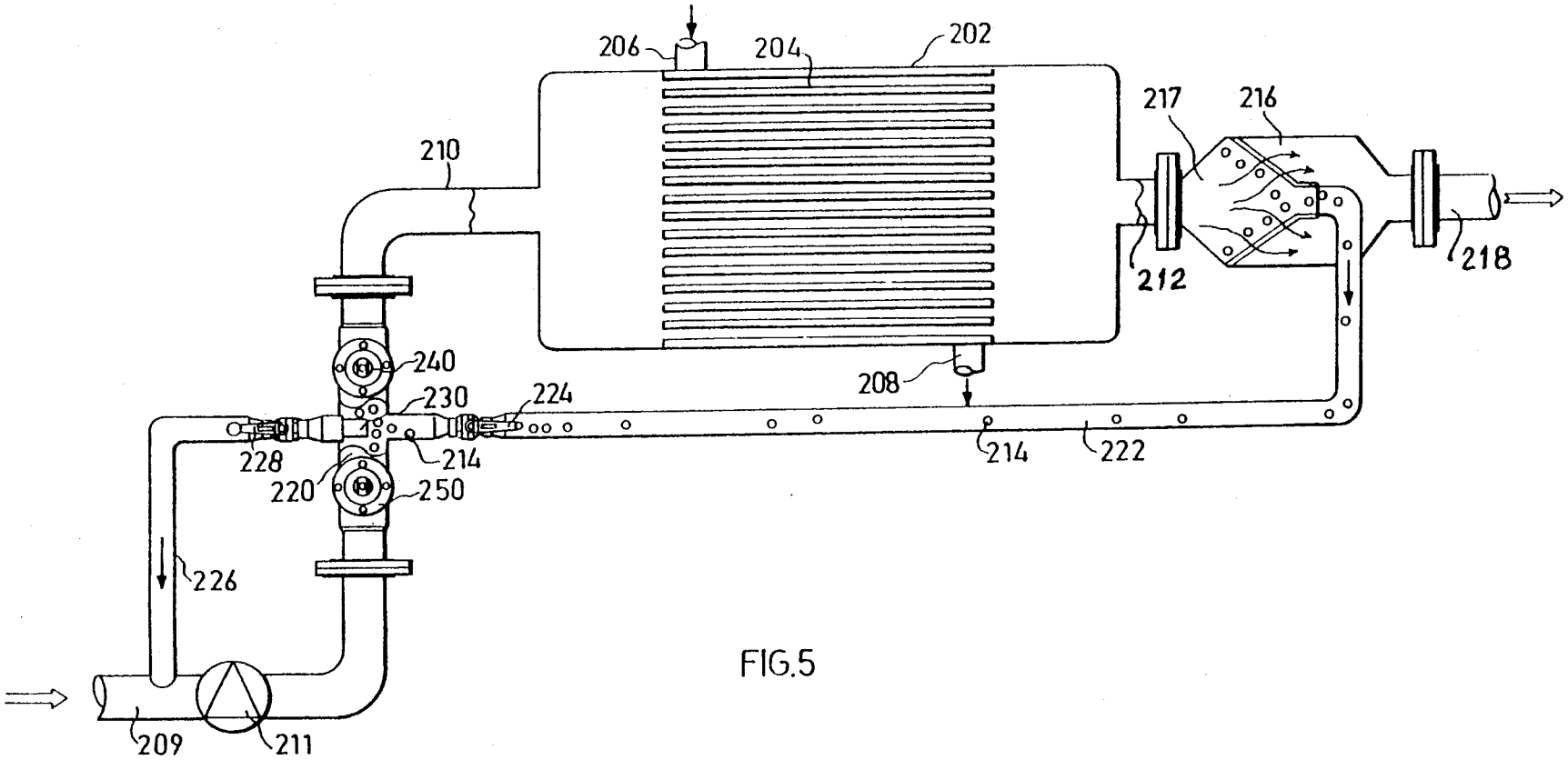
FIG. 5 illustrates a cleaning system similar to that of FIGS. 3 and 4.

The cleaning system illustrated in FIGS. 5–7 is similar to that of FIGS. 3 and 4. It comprises a condenser, generally designated 202, including tubing 204 in the form of a plurality of parallel, spaced tubes through which the cooling fluid, such as water, is passed in order to condense a fluid, such as steam or a refrigerant gas, circulated from an inlet 206 through the spaces between the condenser tubing 204 to an outlet 208. The cooling liquid is introduced through an inlet tube 209 and is driven by circulating pump 211 through the condenser tubing 204 via an inlet header 210 at the upstream side of the condenser to an outlet header 212 at the downstream side.

In order to prevent the lodging or settling of particles within the condenser tubing 204 which tend to clog or erode the tubing, the cleaning liquid includes a plurality of cleaning balls 214 forced through the tubing 204 with the cooling liquid. Balls 214 are slightly larger in diameter than the condenser tubes 204 so that they rub against the inner walls of the tubes and thereby maintain them clean. Thus, any solid particles suspended in the cleaning liquid are kept moving and not allowed to settle, thereby preventing clogging of the tubes.

The outlet header 212 includes a separator or strainer in the form of a conical screen 216 in region 217 at the upstream side of the condenser tubing 204. Screen 216 separates the cleaning balls 214 from the cooling liquid as the cooling liquid passes through separator 216 to the cooling liquid outlet 218. The cleaning balls 214 thus separated by separator 216 are fed to a chamber 220 via a connecting passageway 222 as controlled by a valve 224. Chamber 220 is connected to a second passageway 226 via a second valve 228 leading to the inlet tube 209 at a point upstream of the circulation pump 211.

Chamber 220 includes a hollow separator tube 230 having perforations 231 through its wall, such that when valve 228 is open, the cooling liquid in chamber 220 flows into the interior of the hollow separator tube 230 and therethrough into passageway 226 and back to the inlet tube 209; on the other hand, the balls 214, being blocked by the openings 231, accumulate on the outer surface of tube 230.

Separator chamber 220 includes two valves, generally designated 240 and 250, respectively, at the opposite ends of the chamber. Thus, valve 240 includes a reciprocatable actuator 241 carrying a circular valve member 242 seatable within a circular valve seat 243 at the side of the separator chamber 220 adjacent to the upstream side of the tubing 210; and valve 250 includes a reciprocatable actuator 251 carrying a circular valve member 252 seatable in a circular valve seat 253 at the opposite side of the separator chamber 220 adjacent to the inlet tube 209.

During the normal operation of the condenser, valves 224 and 228 are in their closed condition. Accordingly, the cleaning balls 214 forced through the condenser tubing 204 are separated by screen 216 and collect within region 217 at the downstream side of the condenser tubing 204.

Periodically, or whenever it is desired to recirculate the balls back to the upstream side of the condenser tubing 204, both valves 224 and 228 are opened, as shown in FIG. 5, so as to produce a flow of the liquid, together with the balls 214, from region 217 through passageway 222 and into chamber 220. The liquid flows through openings 231 in the hollow separator tube 230 and into passageway 226 back to the inlet tube 209 at a point upstream of the circulating pump 211, which point is at a lower pressure than region 217. However, since both valves 240 and 250 are in their closed conditions, the balls 214 accumulate on the outer face of the hollow separator tube 230 in chamber 220 as shown in FIGS. 6 and 6*a*.

Valves 224 and 228 are then closed, and valves 240 and 250 are opened, as shown in FIGS. 7 and 7*a*. This causes the fluid flowing via the inlet tube 209 to the inlet header 210, to flow through the separator chamber 220 and thereby to wash the balls 214 accumulating therein into the inlet header 210. After the balls have thus been washed out of the separator chamber 220 back into the inlet header 210, the two valves 240 and 250 are again closed.

What is claimed is:

1. A cleaning system for cleaning tubing used for conducting a fluid therethrough, which system includes balls circulated with the fluid through the tubing from its upstream side to its downstream side, means for separating the balls from the fluid at the downstream side of the tubing, and recirculating means for recirculating the balls back to the upstream side of the tubing; said recirculating means comprising a chamber, a first passageway from said chamber to the downstream side of the tubing where the balls are separated from the fluid, and a second passageway leading from said chamber to a point of lower pressure than in said chamber; a valve in said second passageway effective when opened to produce, by the difference in pressure between said downstream side of the tubing and said point of lower pressure, a flow of the fluid and balls from said downstream side of the tubing to said chamber; and a separator between said chamber and said second passageway to permit the fluid, but not the balls, to flow through said second passageway to said point of lower pressure; said separator including a hollow separator tube having perforations through its wall such that the balls accumulate in said chamber on the outer side of said hollow separator tube while the fluid flows through the interior of the hollow separator tube through said second passageway to said point of lower pressure; said chamber including a first valve between one side of the chamber and a point at the upstream side of the tubing, and a second valve between its opposite side and another point at the upstream side of said tubing but further upstream than said first-mentioned point, such that when both valves are opened, fluid in the upstream side of said tubing passes through said chamber and washes said balls into the upstream side of the tubing.

2. The system according to claim 1, wherein the upstream side of the tubing includes a circulating pump, and said second passageway leads from said chamber back to said upstream side of the tubing upstream of said circulating pump.

3. The system according to claim 1 wherein: said first valve includes a circular valve member carried by a first reciprocatable actuator and seatable in a first circular valve seat in said chamber on one side of said hollow separator tube; and said second valve includes a circular valve member carried by a second reciprocatable actuator and seatable in a second circular valve seat in said chamber on the opposite side of said hollow separator tube.

4. A cleaning system for cleaning tubing used for conducting a fluid therethrough, which system includes balls circulated with the fluid through the tubing from its upstream side to its downstream side, means for separating the balls from the fluid at the downstream side of the tubing, and recirculating means for recirculating the balls back to the upstream side of the tubing; said recirculating means comprising a chamber, a first passageway from said chamber to the downstream side of the tubing where the balls are separated from the fluid, and a second passageway leading from said chamber to a point of lower pressure than in said chamber; a valve in said second passageway effective when opened to produce, by the difference in pressure between said downstream side of the tubing and said point of lower pressure, a flow of the fluid and balls from said downstream side of the tubing to said chamber; and a separator between said chamber and said second passageway to permit the fluid, but not the balls, to flow through said second passageway to said point of lower pressure; said separator including a hollow separator tube having perforations through its wall such that the balls accumulate in said chamber on the outer side of said hollow separator tube while the fluid flows through the interior of the hollow separator tube through said second passageway to said point of lower pressure, said hollow separator tube being carried by an ejector operable to eject the hollow separator tube, and the balls accumulated thereon, outwardly of said chamber and into the upstream side of said tubing.

* * * * *